US006302333B1

(12) United States Patent
Hoffmann et al.

(10) Patent No.: US 6,302,333 B1
(45) **Date of Patent: *Oct. 16, 2001**

(54) INJECTOR FOR FUEL INJECTOR SYSTEMS

(75) Inventors: Karl-Heinz Hoffmann, Stuttgart; Heinz Oeing, Dersum; Gregor Renner, Stuttgart; Reinhard Fischer, Holzkirchen; Guenter Vogt, Rolle/Schweiz; Jens-Peter Wobbe, Simmental, all of (DE)

(73) Assignees: DaimlerChrysler AG, Stuttgart; Fa. Erphi-Electronic GmbH, Holzkirchen; P & S GmbH, Bad Sobernheim, all of (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/293,767

(22) Filed: Apr. 19, 1999

(30) Foreign Application Priority Data

Apr. 18, 1998 (DE) ..... 198 17 320

(51) Int. Cl.[7] ..... F02M 47/02

(52) U.S. Cl. ..... 239/88; 239/102.2; 239/533.7; 239/533.9

(58) Field of Search ..... 239/102.1, 102.2, 239/533.9, 533.7, 88, 90, 93, 95

(56) References Cited

U.S. PATENT DOCUMENTS

| | | | | |
|---|---|---|---|---|
| 5,413,076 | * | 5/1995 | Koenigswieser et al. | 123/446 |
| 5,697,554 | * | 12/1997 | Autwaerter et al. | 239/88 |
| 5,931,390 | * | 8/1999 | Hoffmann et al. | 239/562 |

FOREIGN PATENT DOCUMENTS

| | | |
|---|---|---|
| 19500706A1 | 7/1996 | (DE) . |
| 19519191C2 | 12/1996 | (DE) . |
| 0218895B1 | 4/1987 | (EP) . |

* cited by examiner

*Primary Examiner*—David A. Scherbel
*Assistant Examiner*—Christopher S. Kim
(74) *Attorney, Agent, or Firm*—Crowell & Moring LLP

(57) ABSTRACT

An injector for a fuel injection system is provided with an injector housing in which a piezoelectric stack is located and with a valve housing connected with the injector housing in which a valve closing device with a jet needle is displaceably located. The valve closing device can be actuated by the piezoelectric stack. The valve closing device can be reset by a return device. A hydraulic following amplifier is located between the piezoelectric stack and the jet needle of the valve closing device. The amplifier has a displacement piston actuated by the piezoelectric stack. A control piston located downstream from the displacement piston and increases the displacement travel. A working piston that actuates the jet needle and increases the actuating force.

19 Claims, 3 Drawing Sheets

INJECTOR FOR FUEL INJECTOR SYSTEMS

BACKGROUND AND SUMMARY OF THE INVENTION

This application claims the priority of German application 198 17 320.2, filed in Germany on Apr. 18, 1998, the disclosure of which is expressly incorporated by reference herein.

The invention relates to an injector for fuel injection systems of the type comprising

- an injector housing in which a piezoelectric stack is located,
- a valve housing connected with the injector housing in which a valve closing device, which can be operated by the piezoelectric stack, and provided with a jet needle, is displaceably mounted,
- a return device being provided by means of which the valve closing device can be returned,
- a displacement piston actuated by the piezoelectric stack being located between the piezoelectric stack and the jet needle of the valve closing device, and
- a control piston located downstream from the displacement piston that increases the adjustment travel.

An injector of the above noted general type is known from German Patent Document DE 195 19 191 C2. A hydraulic distance transformation unit is located between a piezoelectric stack and the jet needle of the injector. This unit has a displacement piston and a control piston located downstream from the displacement piston. However, the fact that the actuating force for the jet needle decreases during the travel transformation is disadvantageous.

A fuel injector for internal combustion engines is known from German Patent Document DE 195 00 706 A1, said valve having a hydraulic travel amplifier for converting a travel of the piezoelectric actuator. In this valve, passages that supply a fluid and carry fluid away are separate from one another, with the fluid being guided into an annular space by a passage located in the valve housing. However, the disadvantage of this injector is that, although the travel is amplified, the actuating force is reduced at the same time by the law of the lever. It is also disadvantageous that the passage of the fuel injector is subjected to a bending stress while fuel is being supplied to the annular chamber.

Reference is made regarding additional prior art to European Patent Document EP 0 218 895 B1, from which a metering valve for metering fluids or gases with a piezoelectric actuator is known. The pressure with which the valve is actuated acts on the piezoelectric actuator directly. At the pressures of approximately 1000 bars that develop in fuel injection systems, exact function of the valve is no longer guaranteed because of losses in the actuating travel of the jet needle. It is also disadvantageous that, after the jet needle lifts out of the valve seat, the fuel sprays uncontrollably into the combustion chamber through the resulting gap.

A goal of the present invention is to provide an injector of the type referred to above with which fuel injection can be performed with high accuracy and precision and without loss of fuel by transformation of the travel.

According to the invention, this goal is achieved by providing an arrangement wherein a working piston is provided for hydraulic following amplification that actuates the jet needle and increases the actuating force.

By using a hydraulic follower amplifier in the form of a working piston it is possible to decouple the system in terms of force. The travel of the piezoelectric stack is transmitted to a displacement piston. A control piston connected downstream from the displacement piston which increases the adjustment travel produced by the piezoelectric stack moves at a specified transformation ratio toward the jet needle. The jet needle is then actuated by a working piston that increases the actuating force.

The travel amplification according to the invention is decoupled from the force because the application of force to open the jet needle comes only from the system pressure, for example a rail pressure. Since there is no loss of power in the transformation, the actuation of the piezoelectric stack also does not have a negative influence on the opening of the jet needle.

In a highly advantageous improvement of certain preferred embodiments of the invention, provision is made such that a pressure compensating chamber is located for a hydraulic length compensation of the piezoelectric stack between the displacement piston and the control piston, said chamber being connected on one side with an overflow line of the control piston and on the other side with an overflow line of the displacement piston.

The pressure compensating chamber according to the invention together with its hydraulic compensating volume serves to compensate temperature and elongation effects of the piezoelectric stack.

In another likewise highly advantageous feature of certain preferred embodiments of the invention, provision can also be made for a pressure pad to be located between the jet needle and the working piston for hydraulic length compensation for the jet needle, with a length compensating chamber with a compensating spring being located between the pressure pad and the working piston.

As a result of this design according to the invention, hydraulic length compensation is achieved for the jet needle, due to thermal and hydraulic changes in length.

The injector according to the invention is suitable for jet needles that open outward as well as those that open inward using the same operating principle.

Other objects, advantages and novel features of the present invention will become apparent from the following detailed description of the invention when considered in conjunction with the accompanying drawings.

DETAILED DESCRIPTION OF THE DRAWINGS

Figure 1:
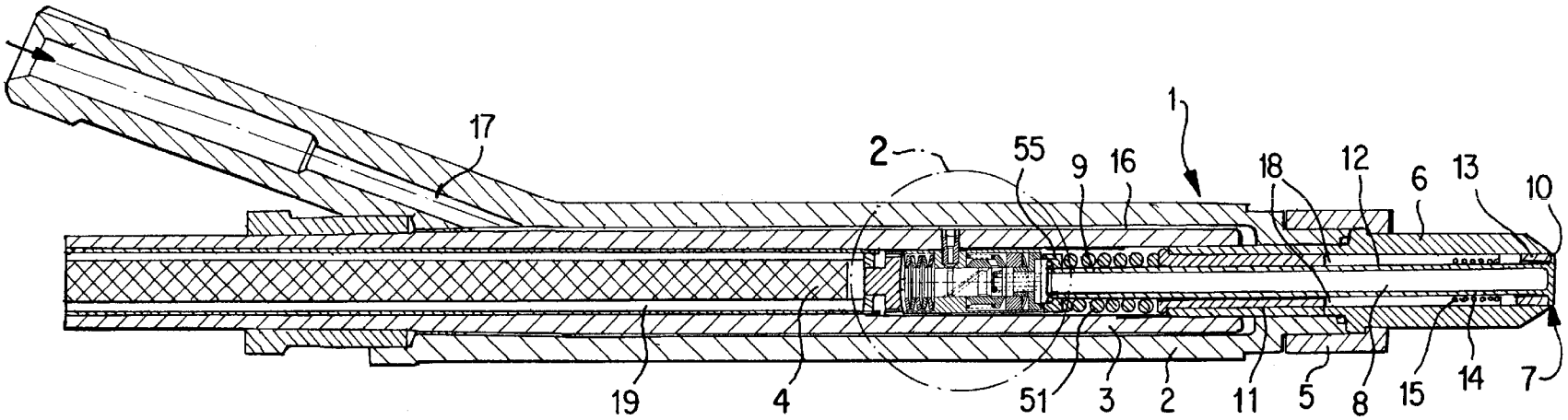
FIG. 1 is an overall side sectional view of an injector constructed according to a preferred embodiment of the invention.

The injector 1 shown in FIG. 1 has an injector housing 2, a piezoelectric guide 3 in which a piezoelectric stack 4 is located and a valve housing connected with injector housing 2 by means of a union nut 5. A valve closing device 7 is displaceably mounted in valve housing 6.

Valve closing device 7 has tappet 8 as a jet needle with a valve stem 9 into which tappet 8 fits.

At the end of the valve stem 9 facing the combustion chamber, a sealing member is provided in the form of a shoulder 10. Valve housing 6, shoulder 10, and a separating device connected with valve stem 9, which is designed as a pressure compensating cylinder 11, form an annular gap 12 that is filled with fuel during operation. When valve 1 is open, a precisely metered quantity of fuel is sprayed from annular gap 12 into a combustion chamber, not shown in the drawing. For this purpose, a flow restricter 13 is used that is pressed by a spring device 14 against a cross-sectional area of shoulder 10 of valve stem 9. Spring device 14 abuts a cylindrical stop 15.

An annular chamber 16 is formed between piezoelectric guide 3 and injector housing 2, in which chamber a line 17 that supplies fuel to valve 1 terminates. From here the fuel flows through bores 18 into annular gap 12.

Piezoelectric stack 4 is located completely in the low-pressure area of passages that carry fuel away and therefore is not adversely affected by the fuel supplied at very high pressure. The reverse flow of fuel in this pressure area takes place in an annular chamber 19 where it escapes from the end of piezoelectric stack 4 that faces away from the combustion chamber.

If a control voltage is applied to piezoelectric stack 4, it produces in known fashion an elongation of piezoelectric stack 4, causing valve closing device 7 to open, since a corresponding gap results between shoulder 10 of valve stem 9 and a valve seat 6 and/or the flow restricter 13. To end the injection process, the control voltage is switched off, whereupon piezoelectric stack 4 again shrinks to its original length. Jet needle 8 is returned by a jet needle spring 51 that abuts an annular bead 55 of jet needle 8.

Figure 2:
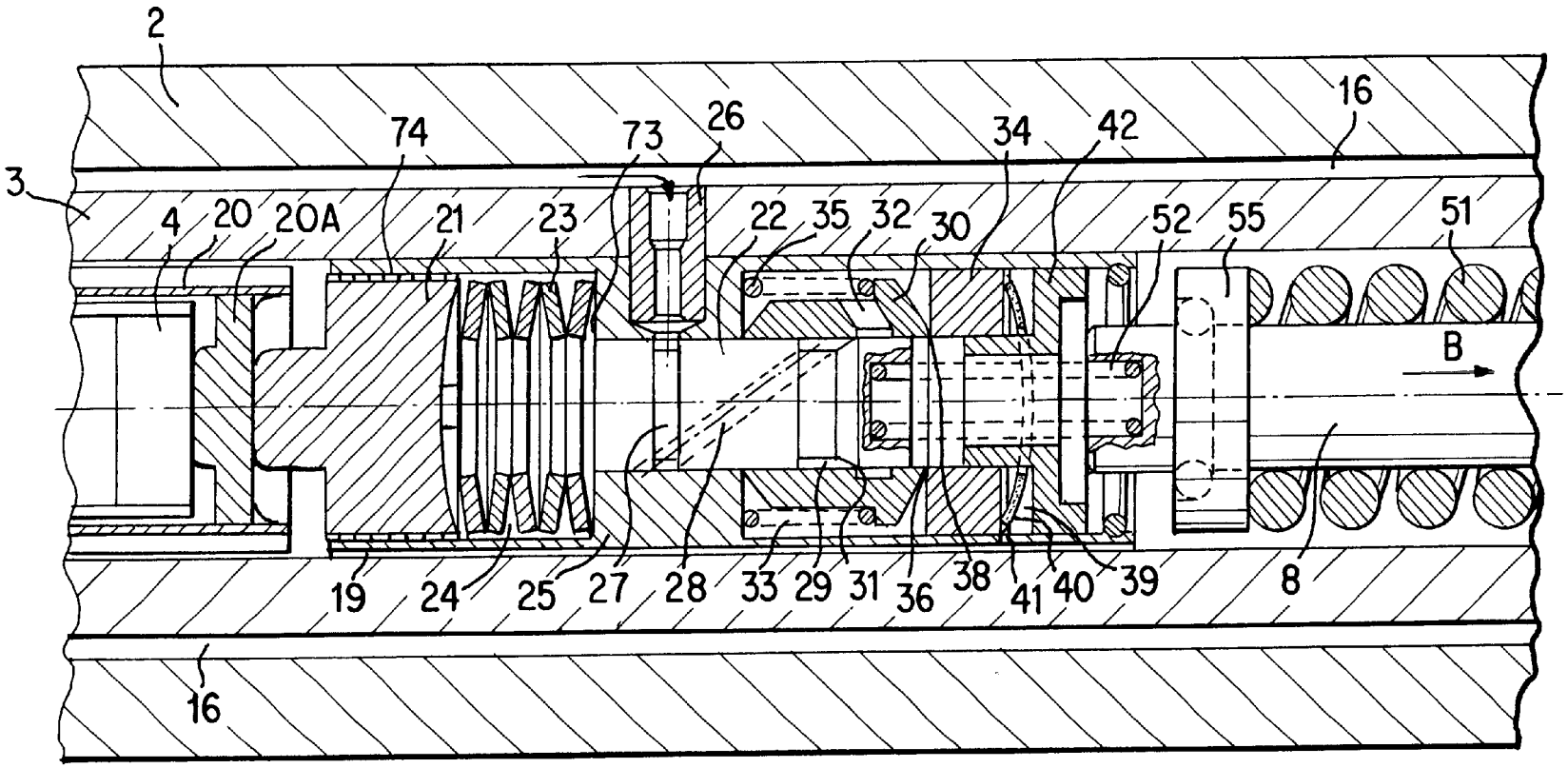
FIG. 2 is an enlargement of a portion of circle "X" in FIG. 1.

FIG. 2 shows the transmission of force from piezoelectric stack 4 to jet needle 8 to open it. Piezoelectric stack 4 is surrounded by a protective tube 20 provided with a seal 20A on the end. The sealing cap 20A of protective tube 20 is located axially between piezoelectric stack 4 and a displacement piston 21, and thus actuates the piston when piezoelectric stack 4 lengthens. A control piston 22 is located axially in front of displacement piston 21 relative to the combustion chamber. Control piston 22 has a smaller effective pressure area than displacement piston 21. The hydraulic transformation ratios result from the different geometries and/or diameter ratios of the displacement piston 21 and control piston 22. A piezoelectric stack pretensioning is produced by a plurality of cup springs 23 arranged one behind the other, said springs being located in a pressure compensating chamber 24. Pressure compensating chamber 24 is filled with test oil or with fuel. Filling and/or pressure compensation are performed by deliberate leaks between control piston 22, displacement piston 21, and the surrounding cylindrical housing 25. A feed 26 terminates in cylindrical housing 25, said feed being connected with the annular supply chamber 16. In this fashion, cylindrical housing 25 is mounted axially and nonrotatably. As a result of the specified transformation ratio between displacement piston 21 and control piston 22, control piston 22 is moved more than displacement piston 21.

An annular chamber 29 is supplied with system pressure (rail pressure) from annular chamber 16 from supply line 26 by an annular groove 27 and a diagonal bore 28 located in control piston 22. Annular chamber 29 is formed between control piston 22 and a sliding sleeve 30.

If piezoelectric stack 4 receives a control voltage, the protective tube 20, displacement piston 21, and control piston 22 are displaced in the direction of arrow B. A leading control edge 31 opens between control piston 22 and sliding sleeve 30, producing a high-pressure connection through annular chamber 29 with a bore 32 in sliding sleeve 30 and therefore to a working cylinder and/or working pressure chamber 33 connected therewith, which is located radially between sliding sleeve 30 with trailing control edge 36 and cylindrical housing 25 and axially between one end of cylindrical housing 25 and a working piston 34. As a result of working pressure chamber 33 being charged with high pressure, working piston 34 is displaced in the same direction as control piston 22 in the direction of arrow B. As a result of the pretensioning spring 35, sliding sleeve 30 follows working piston 34 and seals off pressure chamber 33 with trailing control edge 36. Sliding sleeve 30 follows the working piston 34 until it again strikes the leading control edge 31 between control piston 22 and sliding sleeve 30 and/or blocks this control edge. As a result, the working pressure chamber 33 is hydraulically tight and a working piston remains in this position. As may be seen, displacement piston 21 specifies the path for the following amplifier consisting of displacement piston 21, control piston 22, sliding sleeve 30, and working piston 34, which is then switched to jet needle 8.

Because of the differences in diameter of the effective piston areas between displacement piston 21 and control piston 22, control piston 22 travels a greater distance.

If the control voltage is removed from piezoelectric stack 4, displacement piston 21 will be pushed back by the cup springs 23. The increase in volume in pressure compensating chamber 24 enables return spring 52, pretensioned between jet needle 8 and an axial depression in the end of control piston 22, to push control piston 22 backward together with sliding sleeve 30 against the direction of arrow B. As a result, an annular gap 38 is produced between trailing control edge 36 and working piston 34 that makes it possible for oil to flow out from working cylinder 33 in the direction of pressure pad 42 and further into annular chamber 19. The escaped amount allows working piston 34 to return to its starting position.

A hydraulic length compensating chamber 39 for jet needle 8, produced by thermal and hydraulic changes in length, is thus formed by cylindrical housing 25, working piston 34, compensating spring 40, compensating bore 41, and pressure pad 42. Changes in length and therefore changes in volume are compensated by bore 41. In this manner, even if jet needle 8 is compressed, working piston 34 always abuts the return control edge.

Protective tube 20 has the purpose of ensuring that the piezoelectric stack 4 does not come in contact with fuel.

A hydraulic length compensation of piezoelectric stack 4 is achieved by the deliberate leakage 73 of control piston 22 and a capillary 74 machined in the outside diameter of displacement piston 21 through which leakage reaches the return line and/or annular chamber 19.

For practical purposes, there are two systems, one on the piezoelectric stack side and the other on the jet needle side, with the parts always being under pretension and therefore always ensuring a contact, regardless of lengthwise expansion effects or temperature differences. It is also important in this respect that the overflow feed into pressure compensating chamber 24 roughly corresponds to the amount that escapes from it through the overflow line in displacement piston 21 (capillary).

This also means that the pressure in pressure compensating chamber 24 must be lower than the spring force of return spring 52. Cup springs 23 ensure that the displacement piston 21 always abuts the piezoelectric stack 4 and the piezoelectric stack 4 is simultaneously pretensioned.

The mechanical performance of piezoelectric stack 4 is used exclusively for valve positioning. In other words, this means that the increase in force has nothing directly to do with piezoelectric stack 4. Therefore, it is not the piezoelectric force that is used to actuate jet needle 8, but only the pressure developed in the pressure chamber of working cylinder 33, and this pressure is proportional to the actuating force.

The embodiment described above relates to a jet needle 8 that opens outward, while the direction of travel of piezoelectric stack 4 corresponds to the direction of travel of the opening of the jet. It is advantageous to keep the loss of oil through lengthwise groove 19 to 3 to 5 bars counterpressure (cavity formation, cavitation).

Figure 3:
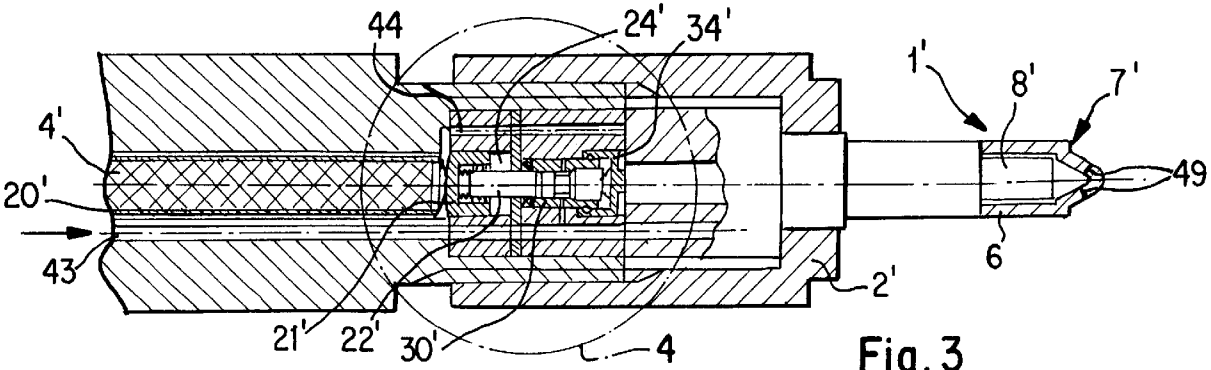
FIG. 3 is a sectional view through an injector with a jet needle that opens inward, constructed in accordance with another preferred embodiment of the invention.
Figure 4:
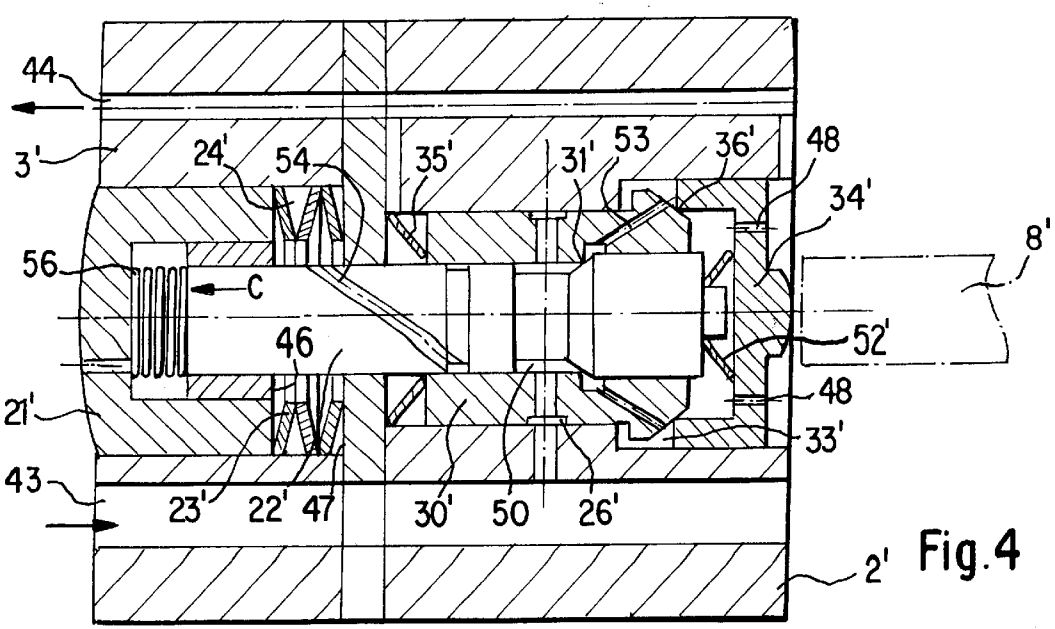
FIG. 4 is an enlargement of a portion of circle "Y" in FIG. 3.

FIGS. 3 and 4 show an injector in which jet needle 8' opens inward to inject fuel. This means that the actuating direction of piezoelectric stack 4' is opposite to the direction of actuation of jet needle 8'. In this embodiment, we have used the same reference numbers with a corresponding superscript for those parts that have the same functions as in the embodiment according to FIGS. 1 and 2. That is, the injector 1', injector housing 2', guide 3', valve housing 6', valve closing device 7' and protective tube 20' correspond in function to FIGS. 1 and 2.

In contrast to the embodiment according to FIG. 1, an annular line 16 is not provided for supplying rail pressure, but a stub 43. An overflow line 44 is provided to return fuel. The piezoelectric pretensioning can be set in pressure compensating chamber 24' by cup springs or coil springs 23'. In this injector system, the direction of travel must be reversed when piezoelectric stack 4' is actuated. In this case, the space in which a spring 56 is located is only a vent space. The pressure compensating chamber 24' on the other hand is compressed with a control voltage on piezoelectric stack 4.

In addition, a difference in diameter is operational in pressure compensating chamber 24'. The difference in the diameters of the effective piston areas of compensating piston 21' and control piston 22' in order to achieve the desired transformation ratios and hence a greater travel for control piston 22', result from a smaller effective end area 46 that acts in the direction of piezoelectric stack 4', by comparison with an effective end area of 21', which is directed toward jet needle 8'. If the pressure compensating chamber 24' is made smaller by a control voltage on piezoelectric stack 4', a pressure buildup occurs in this chamber that actuates control piston 22' opposite to the direction of action of piezoelectric stack 4' in the direction of arrow C. With control piston 22' in this displacement direction, it carries sliding sleeve 30' in direction C as well. As a result of this displacement, pressure release occurs in a working cylinder 33' which corresponds to the working cylinder in the embodiment shown in FIGS. 1 and 2. The pressure relief occurs in working cylinder 33' into overflow line 44 through bores 48 in working piston 34'. Since the direction is reversed in this embodiment, it means that the leading control edge 31' closes jet needle 8' and trailing control edge 36' between sliding sleeve 30' and working piston 34' opens jet needle 8' and hence creates a connection between supply line 43 and injection holes 49 for injecting fuel.

To close injection holes 49 following elimination of the control voltage from piezoelectric stack 4', a pressure buildup again occurs via leading control edge 31' in working cylinder 33', since sliding sleeve 30' encounters working cylinder 34' by return control edge 36', interrupting the connection to overflow line 44. This means that when jet needle 8' is in its closed position, the full system pressure is available in the pressure chamber of working cylinder 33', since the pressure chamber of working cylinder 33' is supplied with the full system pressure through diagonal bores 53 in sliding sleeve 30' by means of leading control edge 31' in conjunction with supply line 26' and an annular chamber 50 between sliding sleeve 30' and control piston 22'. If working piston 34' shifts slightly, leading control edge 31' opens immediately and forms the connection to the high-pressure side at this edge. It is only when control piston 22' is displaced in direction C as a result of a control voltage being applied to piezoelectric stack 4' that the pressure in working cylinder 33' drops accordingly and jet needle 8' can open to inject fuel.

The fuel supply for the pressure compensating chamber 24' comes through a connecting passage 54 in control piston 22' to the feed 26.

Just as in the case of the coil spring 35 in the embodiment shown in FIGS. 1 and 2, sliding sleeve 30 is pressed by a cup spring 35' against working piston 34'. The control piston 22' is returned by a cup spring 52' that abuts working piston 34'.

It is also advantageous in this regard to keep the flow of overflow oil through lengthwise groove 19 to 3 to 5 bars counterpressure.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Injector for fuel injection systems, comprising:

an injector housing in which a piezoelectric stack is located, a valve housing connected with the injector housing in which a valve closing device, which is operated by the piezoelectric stack, and provided with a jet needle, is displaceably mounted, a return device being provided by means of which the valve closing device is returned, a displacement piston actuated by the piezoelectric stack being located between the piezoelectric stack and the jet needle of the valve closing device, and a control piston located downstream from the displacement piston that increases adjustment travel, wherein a working piston downstream from the control piston is provided for hydraulic following amplification that actuates the jet needle and increases an actuating force.

2. Injector according to claim 1, wherein an effective pressure area of the control piston is smaller than that of the displacement piston.

3. Injector according to claim 1, wherein a sliding sleeve is located between the control piston and the working piston, at which sliding sleeve a leading control edge and a trailing control edge are provided to increase the pressure and reduce the pressure in a working chamber of a working cylinder located between the control piston and working piston.

4. Injector according to claim 2, wherein a sliding sleeve is located between the control piston and the working piston, at which sliding sleeve a leading control edge and a trailing control edge are provided to increase the pressure and reduce the pressure in a working chamber of a working cylinder located between the control piston and working piston.

5. Injector according to claim 1, wherein at least one pretensioning device is located between the piezoelectric stack and the jet needle.

6. Injector according to claim 2, wherein at least one pretensioning device is located between the piezoelectric stack and the jet needle.

7. Injector according to claim 3, wherein at least one pretensioning device is located between the piezoelectric stack and the jet needle.

8. Injector according to claim 1, wherein a pressure compensating chamber is provided for a hydraulic length compensation of the piezoelectric stack between the displacement piston and the control piston, said compensation chamber being connected on the one hand with an overflow line of the control piston and on the other hand with an overflow line of the displacement piston.

9. Injector according to claim 2, wherein a pressure compensating chamber is provided for a hydraulic length compensation of the piezoelectric stack between the displacement piston and the control piston, said compensation chamber being connected on the one hand with an overflow line of the control piston and on the other hand with an overflow line of the displacement piston.

10. Injector according to claim 3, wherein a pressure compensating chamber is provided for a hydraulic length compensation of the piezoelectric stack between the displacement piston and the control piston, said compensation chamber being connected on the one hand with an overflow line of the control piston and on the other hand with an overflow line of the displacement piston.

11. Injector according to claim 5, wherein a pressure compensating chamber is provided for a hydraulic length compensation of the piezoelectric stack between the displacement piston and the control piston, said compensation chamber being connected on the one hand with an overflow line of the control piston and on the other hand with an overflow line of the displacement piston.

12. Injector according to claim 1, wherein a pressure pad is provided for hydraulic length compensation for the jet needle between the jet needle and the working piston, with a length compensating chamber with a compensating spring being located between the pressure pad and the working piston.

13. Injector according to claim 2, wherein a pressure pad is provided for hydraulic length compensation for the jet needle between the jet needle and the working piston, with a length compensating chamber with a compensating spring being located between the pressure pad and the working piston.

14. Injector according to claim 3, wherein a pressure pad is provided for hydraulic length compensation for the jet needle between the jet needle and the working piston, with a length compensating chamber with a compensating spring being located between the pressure pad and the working piston.

15. Injector according to claim 5, wherein a pressure pad is provided for hydraulic length compensation for the jet needle between the jet needle and the working piston, with a length compensating chamber with a compensating spring being located between the pressure pad and the working piston.

16. Injector according to claim 8, wherein a pressure pad is provided for hydraulic length compensation for the jet needle between the jet needle and the working piston, with a length compensating chamber with a compensating spring being located between the pressure pad and the working piston.

17. Injector according to claim 1, wherein a reversal of direction between the displacement piston and the control piston takes place, which jet needle opens inward against the direction of piezoelectric actuation of the piezoelectric stack.

18. Injector according to claim 1, wherein the piezoelectric stack is surrounded by a piezoelectric guide.

19. Injector according claim 18, wherein an annular chamber is formed between the piezoelectric guide and the injector housing, in which annular chamber a fuel supply line terminates.

* * * * *